US005603222A

United States Patent [19]

Dubé

[11] Patent Number: 5,603,222

[45] Date of Patent: Feb. 18, 1997

[54] COOLING METHOD AND SYSTEM FOR A COMPRESSOR OF A REFRIGERATING SYSTEM

[76] Inventor: Serge Dubé , 2595 Bourgogne, St. Lazare, Quebec, Canada, J0P 1V0

[21] Appl. No.: 490,422

[22] Filed: Jun. 14, 1995

[51] Int. Cl.[6] ..... F25B 43/02

[52] U.S. Cl. ..... 62/84; 62/469

[58] Field of Search ..... 62/84, 468, 469, 62/505

[56] References Cited

U.S. PATENT DOCUMENTS 3,270,521 9/1966 Rayner et al. ..... 62/84
3,379,033 4/1968 Grant ..... 62/468
3,563,051 2/1971 Baumgartner ..... 62/84
3,710,590 1/1973 Kocher ..... 62/468
5,481,887 1/1996 Terasaki ..... 62/84

*Primary Examiner*—William Doerrler

[57] ABSTRACT

The present invention relates to a method and a system for cooling a piston-driven compressor to permit the compressor to operate with a refrigerant gas, such as freon 22, that would normally cause the compressor to overheat and eventually break down. The method and system comprises connecting a heat exchanger in the cool side of the refrigeration system and connecting it in heat exchange relationship with oil circulated in the compressor to cool the oil to lower the compressor temperature whereby the compressor may operate effectively with the refrigerant gas without overheating.

13 Claims, 2 Drawing Sheets

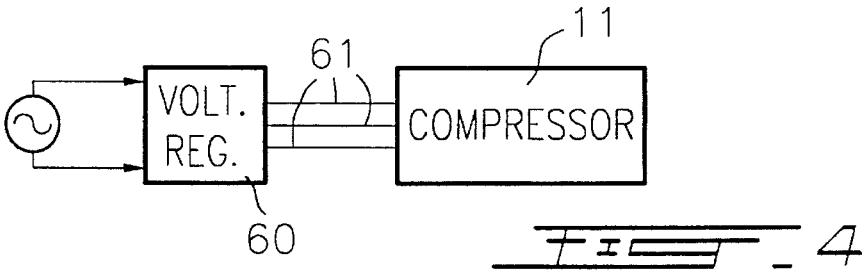
FIG. 4
FIG. 1
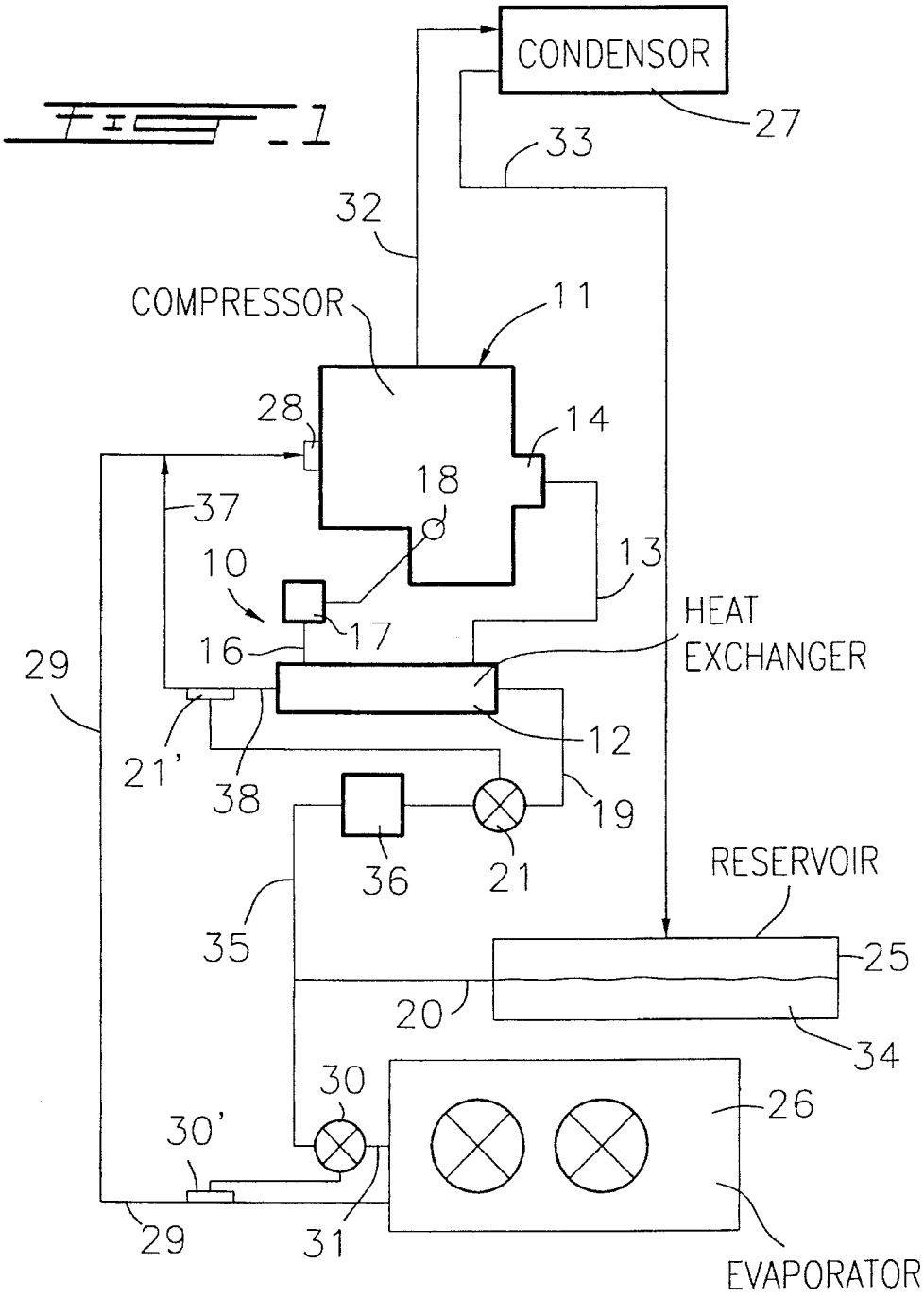

COOLING METHOD AND SYSTEM FOR A COMPRESSOR OF A REFRIGERATING SYSTEM

TECHNICAL FIELD

The present invention relates to a method and a system for cooling a compressor of a refrigerating system to permit the compressor to operate with a refrigerant gas, such as freon 22, that would normally cause this type of compressor to overheat and eventually break down.

BACKGROUND ART

Various new refrigerant gases have been developed to replace certain other refrigerant gases which have become damaging to the ozone in the atmosphere when released therein. These new substitute refrigerant gases such as AZ-50, HP-80, MP-39, HP-62, MP-66, R134A and HP81 are problematic to piston-driven compressors in that they require the replacement of the lubricant oils for synthetic oils in the compressors whereby to prevent the compressors from overheating. These refrigerants and oils are very expensive and develop other problems in that the new lubricants absorb humidity. It is therefore necessary to install dryer cartridges in the liquid refrigerant lines to remove the humidity in the oil and in the refrigerant and this requires additional costs and periodic maintenance to change the filters. In summary, piston-driven compressor manufacturers are recommending that the refrigerant gases be changed for refrigerants which are costly and problematic. Ideally, freon 22 is a refrigerant gas which is less costly and still permissible as it is less damaging to the ozone layer, but the compressors which were built to operate with freon 12 or 502 will heat up and eventually break down if they operate with freon 22 gas. Accordingly, the manufacturers have placed a notice that such compressors cannot use this type of refrigerant gas and the resulting problems are as specified above.

SUMMARY OF INVENTION

I have discovered a method and a system whereby such compressors, such as piston-operated, centrifuge and others, can utilize refrigerant gases, such as freon 22, and wherein the compressor will operate effectively without overheating. I have discovered that by lowering the temperature of the oil in the compressor, which is normally at 150° F. during operation, and which is used to cool the compressor to about 95° F., that this will permit the compressor to operate at a cooler temperature and therefore not overheat and not break down due to this overheating.

In order to further reduce the maximum operating temperature of the compressor, I have found that by connecting a voltage regulating capacitive network in the supply line of the compressor that I can reduce the heat loss further as the motor draws less amperage from the supply and this corrected power factor results in a reduction of the temperature by as much as 30 percent.

My method and system, in one of its aspects, utilizes the interior oil pump of a compressor in order to feed part of the oil within the compressor into a heat exchanger through an external oil line circuit which also employs a pressure regulating valve to lower the pressure and hence the velocity of the oil flow through the heat exchanger to about 20 psi. The cooled oil is then fed back within the compressor to lower the oil temperature.

The method and system that I have devised, in another one of its aspects, requires that a pressure regulated oil pump be connected to an external oil circuit which is connected in the base of the oil reservoir of the compressor and recirculates the oil at a lower pressure into the heat exchanger and then back into a higher part of the oil reservoir or any other suitable part of the compressor to cool the oil and the compressor.

In one of its broader aspects, the present invention provides a system for cooling a compressor, to permit the compressor to operate with a refrigerant gas that would normally cause a compressor to overheat and eventually break down. The system comprises a heat exchanger connected in the cool side of a refrigeration system employing the said compressor and connecting same in heat exchange relationship with oil circulated in the compressor to cool the oil from about 150° F. to 95° F. to lower the compressor temperature whereby the compressor may operate effectively with the refrigerant gas without overheating.

According to a further broad aspect, the heat exchanger is connected to an oil pump and pressure regulating means in an external oil line circuit connected to the compressor to recirculate at least part of the oil in the compressor to cool the oil.

According to a still further broad aspect of the present invention the heat exchanger is a jacket formed about a head(s) of the compressor and the oil within the compressor is cooled as it is pumped by the compressor oil pump through the head and wherein the heat exchanger is cooled by a circuit tapped from the cold refrigerant gas line.

According to a still further broad aspect, a voltage regulator capacitive network is connected to an input voltage supply of the compressor to adjust the power factor thereof to correct the amperage drawn by the motor of the compressor to further reduce overheating of the compressor.

According to a still further broad aspect of the present invention there is provided a method of cooling a compressor to permit said compressor to operate with a refrigerant gas that would normally cause the said compressor to overheat and eventually break down. The method comprises the steps of connecting a heat exchanger with a cool side of a refrigeration system employing the compressor. The heat exchanger is disposed in heat exchange relationship with oil circulated in the compressor to cool the oil whereby the compressor may operate effectively with the refrigerant gas without overheating.

According to another broad aspect the method further comprises connecting the heat exchanger to an oil pump and regulating the pressure of the oil by regulating means in an external oil line circuit connected to the compressor whereby to recirculate at least part of the oil in the compressor to cool the oil and hence the compressor.

BRIEF DESCRIPTION OF DRAWINGS

A preferred embodiment of the present invention will now be described with reference to the examples thereof as illustrated in the accompanying drawings in which:

FIG. 3 is an end view of a compressor and wherein the heat exchanger is schematically shown and also illustrated as a jacket secured about the head of a compressor; and FIG. 4 is a simplified block diagram showing the voltage regulator capacitor network connected to the power supply of the compressor.

DESCRIPTION OF PREFERRED EMBODIMENTS

Figure 1:
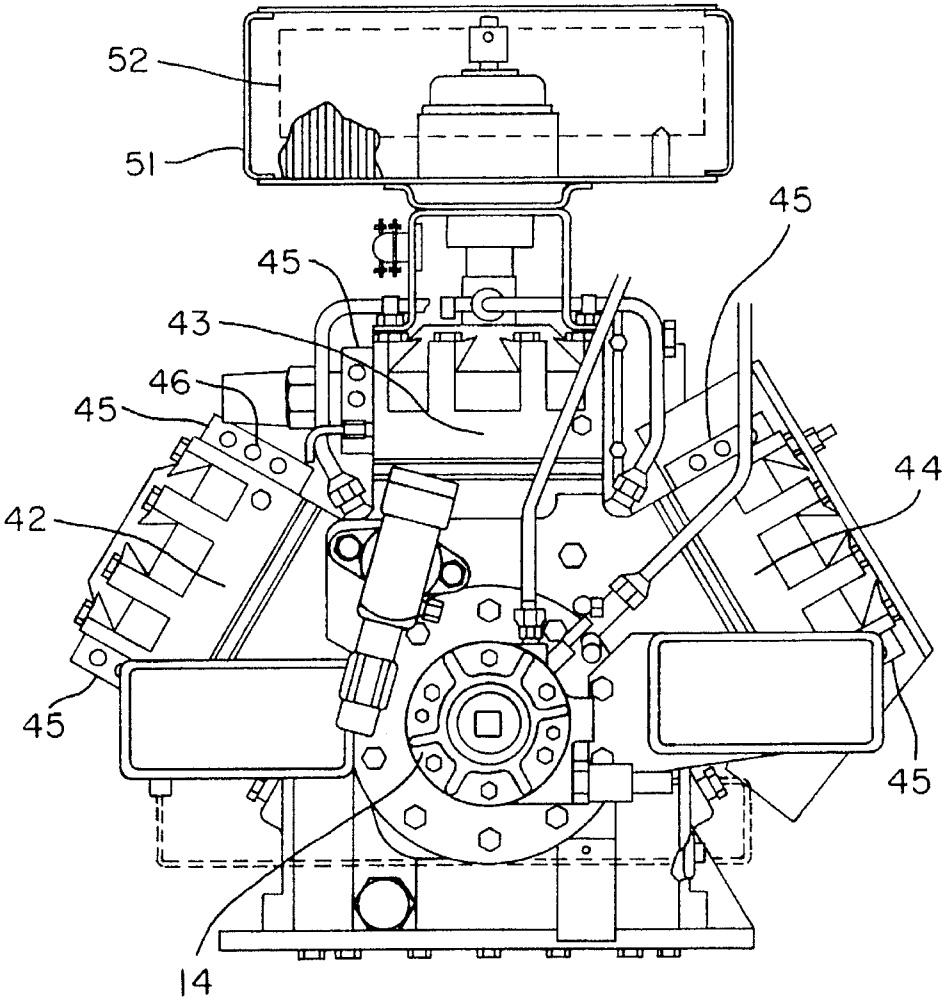
FIG. 1 is a block diagram showing the cooling system of the present invention whereby to cool a piston-driven compressor.

Referring now to the drawings and more particularly to FIG. 1, there is shown generally at 10 the system of the present invention for cooling a compressor 11, herein a piston-driven compressor, whereby to permit this compressor to operate with a refrigerant gas, herein freon 22, that would normally cause the compressor to overheat and eventually break down. The cooling system of the present invention comprises a heat exchanger 12 which is connected to an external oil line circuit comprising oil line 13 connected to the compressor pump 14 which feeds part of the oil within the compressor reservoir 15 into the heat exchanger 12 and out of the heat exchanger through external oil line 16 and through a pressure regulating valve 17 back into the reservoir 15 through a coupling 18 secured in the uppermost part of the reservoir. The heat exchanger 12 is fed by the cool low pressure vapor line 19 connected to the outlet 20 of the compressor and vaporized by the thermostatic expansion valve 21. The pressure of the oil leaving the oil pump 14 is usually at 40 psi and it is lowered by the pressure regulating valve 17 to about 20 psi giving the oil sufficient time to cool down in heat exchange relationship with the cold vapor gas circulating through the line 19 which is disposed in heat exchange relationship therewith in the heat exchanger 12.

As shown in FIG. 1, the compressor 11 is of the type which operates with freon gas 12 and 502 and such compressors are usually provided with a fan which is used to lower the temperature of the compressor by cooling the head(s) of a compressor and therefore the oil circulating therein by a temperature of about 10° F. This is satisfactory for that type of compressor using these specified refrigerants. However, it has been found that when using a refrigerant, such as freon 22 which is much less expensive, that the oil within the compressor would heat up excessively and cause compressor failure including substantial damage thereto. Accordingly, the cooling principle by using a fan is not sufficient to permit a substitute of the refrigerant gas with the standard oils utilized within the compressors. The result is that expensive synthetic oils have to be used so that these compressors can operate with new refrigerants and this conversion has proven to be very costly particularly in refrigerant systems that we find in supermarkets where a great number of refrigerating display cases are utilized costing the merchants excessive investments to convert these systems to meet governmental regulations on the use of freon.

My cooling system as shown in FIG. 1 is connected in the standard refrigeration system as therein shown which shows the compressor 11 used to pump a refrigerant from a liquid refrigerant reservoir 25 through an evaporator 26, such as we find in a cold chamber or refrigerating display case (not shown) and back through a condenser 27 where the vapor gas is liquefied and fed into the reservoir 25.

The temperature which is absorbed by the refrigerant passing through the evaporator is sucked by the compressor 11 to its inlet 28 via the return line 29. The refrigerant in that line is in its vapor state and at low pressure having been vaporized by the thermostatic expansion valve 30 connected in the input line 31 of the evaporator 26. This low pressure refrigerant gas is pumped through the compressor and out through its high pressure line 32 into the condenser 27 which recovers the heat within the gas by cooling down the gas to liquefy same. The output line 33 of the condenser 27 therefore contains high pressure liquefied refrigerant which is fed to the reservoir 25.

As previously described, the oil within the compressor is cooled by the heat exchanger 12 which is fed cool refrigerant liquid 34 contained within the reservoir 25 and this is done through a branch line 35 connected to the outlet 20 of the reservoir and in which there is connected a solenoid valve 36 which shuts off the flow of the liquid refrigerant once the compressor 11 shuts off. When the compressor operates, the valve 36 opens and feeds the high pressure liquid refrigerant to the expansion valve 21 which vaporizes the refrigerant liquid and through the line 19 feeds it through the heat exchanger 12 for heat exchange relationship with the hot oil. A return line 37 containing the refrigerant vapor from the outlet 38 of the heat exchanger 12, connects the vapor to the return line 29 where the cooler vapor mixes with the hotter vapor from the output of the evaporator 26 thereby resulting in a first stage of cooling the odd vapor fed to the inlet 28 of the compressor 11. This also results in increased efficiency of the compressor. As herein shown the expansion valve 21 has a thermostat 21' connected to the line 37. The expansion valve 30 also has a thermostat 30' connected to the output line or the return line 29 from the evaporator.

Figure 2:
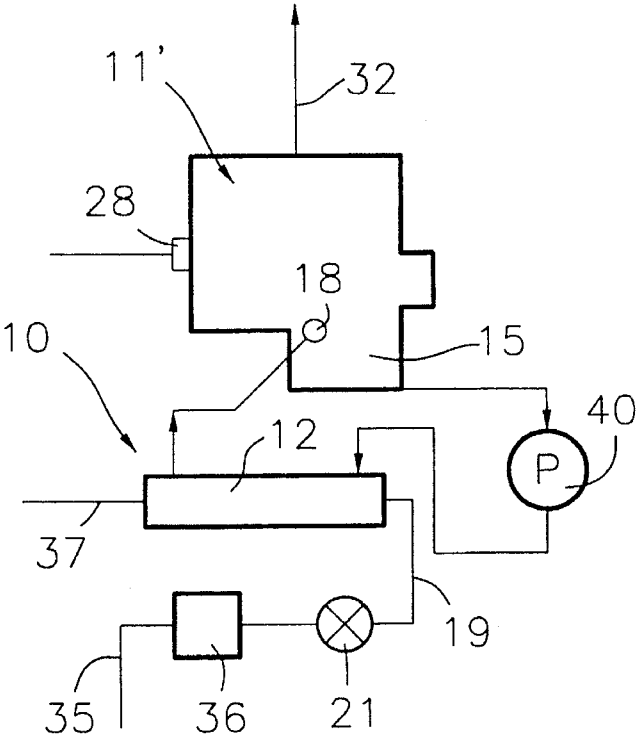
FIG. 2 is a further block diagram showing a modification of the connection of the heat exchanger with the compressor.

As shown in FIG. 2, my oil cooling system 10' may also be adapted to the compressor 11 as a separate circuit without using the oil pump 14 of the compressor in which the oil circulated thereby is at 40 psi. By using a separate pump 40 we draw oil from the base, i.e. the pan 15 which oil is at about 20 psi and pump it at about 25 psi through the heat exchanger 12 and the fitting 18 connected to an upper part of the reservoir. The lines 37, 19 and 35 including the solenoid 36 and expansion valve 21 are also connected to the heat exchanger to effectuate the cooling of the oil as previously described.

As shown in FIG. 3, there is shown a typical construction of the type of compressors hereinabove described showing three cylinder heads 42, 43 and 44 in which are disposed, respectively, two pistons (not shown). In one of its embodiments, the heat exchanger may be constructed as a jacket 45 which may be disposed about one or all of these cylinder heads 42, 43 and 44 with the cool refrigerant circulated through pipes 46 disposed in heat exchange relationship with the heads. As herein shown, the compressor is provided with a fan housing 51 in which a fan 52 is disposed to create an airflow about the compressor to cool same. However, as previously described, such fans do not provide sufficient cooling and may be maintained with the cooling system of the present invention.

FIG. 4 is a schematic diagram also showing a further improvement of these compressors to reduce the operating temperature of the oil circulated therein. In one of its aspects, my invention also provides a voltage regulating capacitive network 60 (well known in the art) which I connect to the supply lines 61 of the compressor motor whereby to automatically adjust the power factor thereof to provide the correct amperage consumption taking into account induction losses in the motor of the compressor. This further reduces overheating by approximately 30 percent. By providing a heat exchanger to cool the oil, I reduce the temperature of the hot oil by about 50 percent. Accordingly, by utilizing my heat exchanger and optionally the voltage regulator 60, the oil within the compressor is considerably cool permitting the compressor to operate with freon 22, which otherwise was not possible as it would have led to compressor failure causing the compressor to overheat and the pistons to seize within the piston cylinders.

In its broad aspect, the method of the present invention consists of connecting a heat exchanger with a cool side of a refrigeration system employing the compressor and disposing the heat exchanger in heat exchange relationship with the oil circulated within the compressor whereby to cool the oil so that the compressor may operate effectively with a particular refrigerant gas, such as freon 22, without overheating. The heat exchanger is also connected to an oil pump, either the oil pump of the compressor wherein a pressure regulator is required to lower the pressure of the oil, or through another pressure regulated pump operating at a reduced pressure so that oil may flow in heat exchange relationship with the cooling fluid in the heat exchanger. The method also encompasses connecting the heat exchanger provided with a serpentine conduit of cold refrigerant gas about the heads of the piston cylinders to cool the oil within the heads as it is circulated internally of the compressor.

It is within the ambit of the present invention to cover any obvious modifications of the examples of the preferred embodiment described herein, provided such modifications fall within the scope of the appended claims.

I claim:

1. A system for cooling and controlling the temperature of a compressor to permit said compressor to operate with a Freon 22 refrigerant gas that would normally cause the compressor to overheat and eventually break down, said system comprising a heat exchanger connected in the cool side of a refrigeration system employing said compressor and connecting same in heat exchange relationship with a controlled amount of the oil circulated in said compressor to cool said oil to lower the compressor temperature whereby said compressor may operate effectively with said refrigerant gas without overheating, said compressor having an internal oil pump, an external oil line connected to said internal oil pump to recirculate a portion of the oil in said compressor to cool said oil in said heat exchanger, a pressure valve connected to said external oil line at an output side of said heat exchanger to reduce the pressure of the oil in said external oil line to slow down the flow of oil through said heat exchanger for cooling said oil, said pressure valve reducing said oil pressure from about 40 psi to 20 psi.

2. A system as claimed in claim 1 wherein said heat exchanger is connected to a low pressure liquid line on an outlet of an expansion valve, said expansion valve being connected at an inlet to a high pressure liquid line of said compressor to change mostly liquid refrigerant in said high pressure liquid line to low pressure refrigerant gas at said outlet, said low pressure refrigerant gas when circulated in said heat exchanger absorbing heat from said oil passing through said heat exchanger and feeding said absorbed heat to an inlet of said compressor through a heat exchanger outlet line connected to a return line of an evaporator.

3. A system as claimed in claim 1 wherein said heat exchanger is connected in close proximity to said compressor, said refrigerant gas in said heat exchanger outlet line being at a lower temperature than refrigerant gas in a return line.

4. A system as claimed in claim 3 wherein an oil reservoir is connected to a cold side of a condenser of a refrigerating system, said compressor high pressure liquid line being connected to an evaporator through an expansion valve, said return line being connected to an outlet of said evaporator to said inlet of said compressor.

5. A system as claimed in claim 4 wherein said evaporator is in a refrigerating display case.

6. A system as claimed in claim 1 wherein said heat exchanger is a jacket formed about a head of said compressor, said oil being cooled as it is pumped through said head by an internal oil pump of said compressor.

7. A system as claimed in claim 1 wherein said compressor is a piston-driven compressor.

8. A system as claimed in claim 1 wherein said oil is cooled from about 150° F. to 95° F.

9. A system as claimed in claim 1 wherein there is further provided a voltage regulator capacitor network connected to an input voltage supply of said compressor to adjust the power factor thereof to correct the voltage supply due to induction losses in a motor of said compressor to further reduce overheating of said compressor.

10. A system for cooling and controlling the temperature of a compressor to permit said compressor to operate with a Freon 22 refrigerant gas that would normally cause the compressor to overheat and eventually break down, said system comprising a heat exchanger connected in the cool side of a refrigeration system employing said compressor and connecting same in heat exchange relationship with a controlled amount of the oil circulated in said compressor to cool said oil to lower the compressor temperature whereby said compressor may operate effectively with said refrigerant gas without overheating said compressor having an internal oil pump, an external oil line connected to said internal oil pump and to recirculate at least part of the oil in said compressor to cool said oil in said heat exchanger, a pressure valve connected to said external oil line at an output side of said heat exchanger to reduce the pressure of the oil in said external oil line to slow down the flow of oil through said heat exchanger for cooling said oil, said pressure valve reducing said oil pressure from about 40 psi to 20 psi, said heat exchanger being connected to a low pressure liquid line on an outlet of an expansion valve, said valve being connected at an inlet to a high pressure liquid line of said compressor to change mostly liquid refrigerant in said high pressure liquid line to low pressure refrigerant gas at said outlet, said low pressure refrigerant gas when circulated in said heat exchanger absorbing heat from said oil passing through said heat exchanger and feeding said absorbed heat to an inlet of said compressor through a heat exchanger outlet line connected to a return line of an evaporator.

11. A system as claimed in claim 10 wherein said heat exchanger is connected in close proximity to said compressor, said refrigerant gas in said heat exchanger outlet line being at a lower temperature than refrigerant gas in said return line.

12. A system as claimed in claim 11 wherein an oil reservoir is connected to a cold side of a condenser of a refrigerating system, said compressor high pressure liquid line being connected to an evaporator through an expansion valve, said return line being connected to an outlet of said evaporator to said inlet of said compressor.

13. A system as claimed in claim 12 wherein said evaporator is in a refrigerating display case.

* * * * *